US008028512B2

(12) United States Patent
Mendoza et al.

(10) Patent No.: US 8,028,512 B2
(45) Date of Patent: Oct. 4, 2011

(54) ACTIVE COMBUSTION CONTROL FOR A TURBINE ENGINE

(75) Inventors: Robert Eleazar Mendoza, Poway, CA (US); Paul Elliot Morrison, Edmonton (CA); Marco Ezra Leon, San Diego, CA (US); Tiziano Marco Bognuda, Tenero (CH); Satoshi Ito, Santee, CA (US); Shari Turner, legal representative, Santee, CA (US)

(73) Assignee: Solar Turbines Inc., San Diego, CA (US)

( * ) Notice: Subject to any disclaimer, the term of this patent is extended or adjusted under 35 U.S.C. 154(b) by 644 days.

(21) Appl. No.: 11/987,151

(22) Filed: Nov. 28, 2007

(65) Prior Publication Data

US 2009/0133379 A1 May 28, 2009

(51) Int. Cl.
*F02C 9/00* (2006.01)
*F02G 3/00* (2006.01)

(52) U.S. Cl. ..... 60/39.281; 60/776; 60/746; 60/747; 60/725; 60/39.826; 431/114

(58) Field of Classification Search ..... 60/39.281, 60/776, 725, 746, 747; 431/114
See application file for complete search history.

(56) References Cited

U.S. PATENT DOCUMENTS 2,552,658 A 5/1951 Ackerman
2,945,629 A 7/1960 Chute et al.
2,968,925 A 1/1961 Blevans et al.
3,330,541 A 7/1967 Jackson
4,365,756 A 12/1982 Fisher
4,519,372 A 5/1985 Hoffman
4,557,106 A 12/1985 Ffowes Williams et al.
4,644,783 A * 2/1987 Roberts et al. ..... 73/114.07
5,211,004 A 5/1993 Black
5,218,824 A 6/1993 Cederwall et al.
5,321,947 A 6/1994 Sood et al.
5,404,711 A 4/1995 Rajput
(Continued)

FOREIGN PATENT DOCUMENTS

EP 1288642 3/2003

OTHER PUBLICATIONS

Steele, Robert C.; Cowell, Luke H.; Cannon, Steven M.; Smith, Clifford E., Passive Control of Combustion Instability in Lean Premixed Combustors, Journal of Engineering for Gas Turbines and Power, Jul. 2000, 8 pages, vol. 122, ASME.

(Continued)

*Primary Examiner* — Louis J. Casaregola
*Assistant Examiner* — Craig Kim
(74) *Attorney, Agent, or Firm* — Finnegan, Henderson, Farabow, Garrett & Dunner LLP

(57) ABSTRACT

A combustion control system for a turbine engine is disclosed. The combustion control system includes a fuel injector having a main fuel supply and pilot fuel supply coupled to a combustor of the turbine engine. The combustion control system also includes a sensor coupled to a transfer tube. The transfer tube is fluidly coupled to the combustor, and the sensor is configured to detect a pressure pulse in the combustor. A semi-infinite coil is also coupled to the transfer tube. The combustion control system also includes a controller electrically connected to the sensor. The controller is configured to compare an amplitude of the pressure pulse within a frequency range to a threshold amplitude, and adjust the pilot fuel supply in response to the comparison.

13 Claims, 4 Drawing Sheets

U.S. PATENT DOCUMENTS 5,445,517 A 8/1995 Kondou et al.
5,452,574 A 9/1995 Cowell et al.
5,706,643 A 1/1998 Snyder et al.
5,719,791 A 2/1998 Neumeier et al.
5,791,889 A 8/1998 Gemmen et al.
5,809,769 A 9/1998 Richards et al.
5,865,609 A 2/1999 Sowa et al.
6,052,986 A 4/2000 Hoffmann et al.
6,059,560 A 5/2000 Richards et al.
6,092,362 A 7/2000 Nagafuchi et al.
6,145,297 A 11/2000 Nagafuchi et al.
6,164,058 A 12/2000 Dobbeling et al.
6,170,265 B1 1/2001 Polifke et al.
6,202,401 B1 3/2001 Seume et al.
6,205,764 B1 3/2001 Hermann et al.
6,205,765 B1 3/2001 Iasillo et al.
6,269,646 B1 8/2001 Lovett et al.
6,272,842 B1 8/2001 Dean
6,305,927 B1 10/2001 Keller
6,336,806 B1 1/2002 Paschereit et al.
6,343,927 B1 2/2002 Eroglu et al.
6,351,947 B1 3/2002 Keller et al.
6,370,879 B1 4/2002 Stalder et al.
6,430,930 B1 8/2002 Andersson
6,430,933 B1 8/2002 Keller
6,434,945 B1 8/2002 Mandai et al.
6,460,340 B1 10/2002 Chauvette et al.
6,461,144 B1 10/2002 Gutmark et al.
6,464,489 B1 10/2002 Gutmark et al.
6,490,864 B1 12/2002 Joos et al.
6,513,334 B2 2/2003 Varney
6,522,991 B2 2/2003 Banaszuk et al.
6,560,967 B1 5/2003 Cohen et al.
6,568,190 B1 5/2003 Tiemann
6,595,002 B2 7/2003 Weisenstein
6,742,341 B2 6/2004 Ryan et al.
6,837,051 B2 1/2005 Mandai et al.
6,857,271 B2 2/2005 Kraft et al.
6,877,307 B2 4/2005 Ryan et al.
6,883,301 B2 4/2005 Woltmann
6,922,612 B2 7/2005 Nomura et al.
6,959,550 B2 11/2005 Freeman et al.
7,188,465 B2 3/2007 Kothnur et al.
7,197,880 B2 4/2007 Thornton et al.
7,232,308 B2 6/2007 Gutmark et al.
7,234,305 B2 6/2007 Nomura et al.
7,241,138 B2 7/2007 Flohr et al.
2002/0138969 A1 10/2002 Dallmeyer et al.
2002/0148230 A1 10/2002 Halila et al.
2003/0159446 A1 8/2003 Parker et al.
2004/0011020 A1 1/2004 Nomura et al.
2004/0011051 A1 1/2004 Ryan et al.
2004/0025512 A1 2/2004 Davis, Jr. et al.
2004/0055306 A1 3/2004 North et al.
2004/0159103 A1 8/2004 Kurtz et al.
2004/0168520 A1 9/2004 Gleeson et al.
2004/0195389 A1 10/2004 Neumaier et al.
2005/0039460 A1 2/2005 Sobieski et al.
2005/0056024 A1* 3/2005 Lieuwen et al. ..... 60/779
2005/0144955 A1 7/2005 Handelsman et al.
2005/0247064 A1 11/2005 Lieuwen
2006/0000260 A1 1/2006 Benson et al.
2006/0123792 A1 6/2006 Xu et al.
2006/0213200 A1 9/2006 Critchley et al.
2007/0039329 A1 2/2007 Abreu et al.
2007/0056376 A1 3/2007 King
2007/0113560 A1 5/2007 Steber et al.
2007/0119147 A1 5/2007 Cornwell et al.
2007/0130955 A1 6/2007 Vandale et al.
2007/0151252 A1 7/2007 Cornwell et al.
2007/0157624 A1 7/2007 Bland et al.

OTHER PUBLICATIONS

Jayasuriya, Jeevan; Manrique, Arturo, Gas Turbine Combustor Lab Exercise, Royal Institute of Technology, Jan. 31, 2005, 9 pages, Stockholm.

* cited by examiner

ACTIVE COMBUSTION CONTROL FOR A TURBINE ENGINE

TECHNICAL FIELD

The present disclosure relates generally to a system and a process for combustion control of a gas turbine engine, and more particularly, to an active combustion control system and process for a turbine engine.

BACKGROUND

Gas turbine engines are used for generating power in a variety of applications including land-based electrical power generating plants. Turbine engines produce power by extracting energy from a flow of hot gas produced by combustion of fuel and air in a combustion chamber ("combustor") of the turbine. These hot gases are directed over rotatable blades to produce mechanical power before being released into the atmosphere. Turbine engines may be designed to combust a broad range of hydrocarbon fuels, such as natural gas, kerosene, diesel, etc in the combustor. Combustion of hydrocarbon fuel results in the production of combustion byproducts, some of which are considered regulated emissions. These regulated emissions include various forms of nitrogen oxides, collectively known as $NO_x$. In an effort to reduce the emission of $NO_x$ to the atmosphere, government regulations limit the allowable emissions of $NO_x$ from turbines.

It is known that $NO_x$ emissions from turbine engines increase significantly as the combustion temperature rises. One method of limiting $NO_x$ in turbine exhaust is by using a lean mixture of fuel and air (low fuel-to-air ratio) in the combustor. A lean fuel-air mixture reduces the combustion temperature to a degree that reduces $NO_x$ production. While lean fuel-air mixture reduces $NO_x$ emissions, reducing fuel content in the mixture below a threshold value may cause the resulting flame in the combustor to be unstable. Instability of the combustion flame may result in the development of dynamic pressure waves in the combustor. These dynamic pressure waves may range in frequency from a few hertz to a few thousand hertz and occur as a result of the combustion process. These pressure pulses can result in mechanical damage to turbine components and smothering of the flame in the combustor ("lean blow-out"). Increasing the concentration of fuel in the mixture of fuel and air may stabilize the combustion process and reduce (or eliminate) harmful pressure pulses. The increased concentration of fuel may increase the temperature and heat release rate of the resulting flame leading to stabilization of the combustion process. This approach may, however, exacerbate the problem of controlling $NO_x$ production. Therefore, there must be a balance between the concerns of reduced emissions and stable combustion.

U.S. Pat. No. 6,877,307 issued to Ryan et al. ('307 patent) describes a method of controlling the combustion process of a turbine engine by increasing fuel to the combustor to achieve stable combustion. The method of the '307 patent uses a sensor to detect pressure pulses within a combustor. When the sensor detects pressure pulses above a threshold value, fuel flow to the combustor through the pilot is increased by a slight amount. Increasing fuel flow through the pilot increases $NO_x$ emissions. Combustor pressure monitoring is continued and the pilot fuel flow is gradually increased to a level at which the pressure pulses are below the threshold value. The method of the '307, thus, stabilizes the combustion process (by eliminating pressure pulses above a threshold value in combustor) by gradually increasing the pilot fuel to a value that is just enough to stabilize the combustion process.

Although the combustion control system of the '307 patent may eventually stabilize the combustion process while increasing $NO_x$ emission to just the amount needed to achieve stable combustion, the system may have drawbacks. For instance, the gradual increasing of pilot fuel to achieve stable combustion, as disclosed in the '307 patent, may extend the amount of time the turbine engine operates in an unstable condition, and thus increase the potential for damage to the turbine.

SUMMARY

In one aspect, a combustion control system for a turbine engine is disclosed. The combustion control system includes a fuel injector having a main fuel supply and pilot fuel supply coupled to a combustor of the turbine engine. The combustion control system also includes a sensor coupled to a transfer tube. The transfer tube is fluidly coupled to the combustor, and the sensor is configured to detect a pressure pulse in the combustor. A semi-infinite coil is also coupled to the transfer tube. The combustion control system also includes a controller electrically connected to the sensor. The controller is configured to compare an amplitude of the pressure pulse within a frequency range to a threshold amplitude, and adjust the pilot fuel supply in response to the comparison.

In another aspect, a method of operating a gas turbine engine is disclosed. The method includes directing a first amount of fuel into a combustor through a main flow path, and directing a second amount of fuel into the combustor through a pilot flow path. The method also includes combusting the main fuel and the pilot fuel in the combustor, and initiating a pressure pulse in the combustor as a result of the combustion. The method also includes detecting an amplitude of the pressure pulse within a frequency range using a sensor fluidly coupled to the combustor, and increasing the amount of pilot fuel to a third amount in response to the detected amplitude being above a threshold value. The third amount being an amount of pilot fuel that is sufficient to decrease the amplitude below the threshold value. The method further includes decreasing the amount of pilot fuel from the third amount to a fourth amount. The fourth amount being an amount of pilot fuel that is greater than the first amount by an incremental amount.

In yet another aspect, a method of combustion control of a gas turbine engine is disclosed. The method includes directing a first amount of first fuel into a combustor of the turbine engine, and directing a second amount of second fuel into the combustor circumferentially around the first fuel. A sum of the first amount and the second amount being a total fuel supply to the combustor. The method also includes generating a combustion induced pressure pulse in the combustor, and detecting an amplitude of the pressure pulse that is within a frequency range. The method also includes increasing the first fuel amount to a third amount in response to an amplitude that is above a threshold value. The third amount is greater than about 10% of the total fuel supply. The method further includes decreasing the first fuel amount from the third amount to a fourth amount. The fourth amount is about 0.05% to about 1% greater than the first amount.

DETAILED DESCRIPTION

Figure 1:
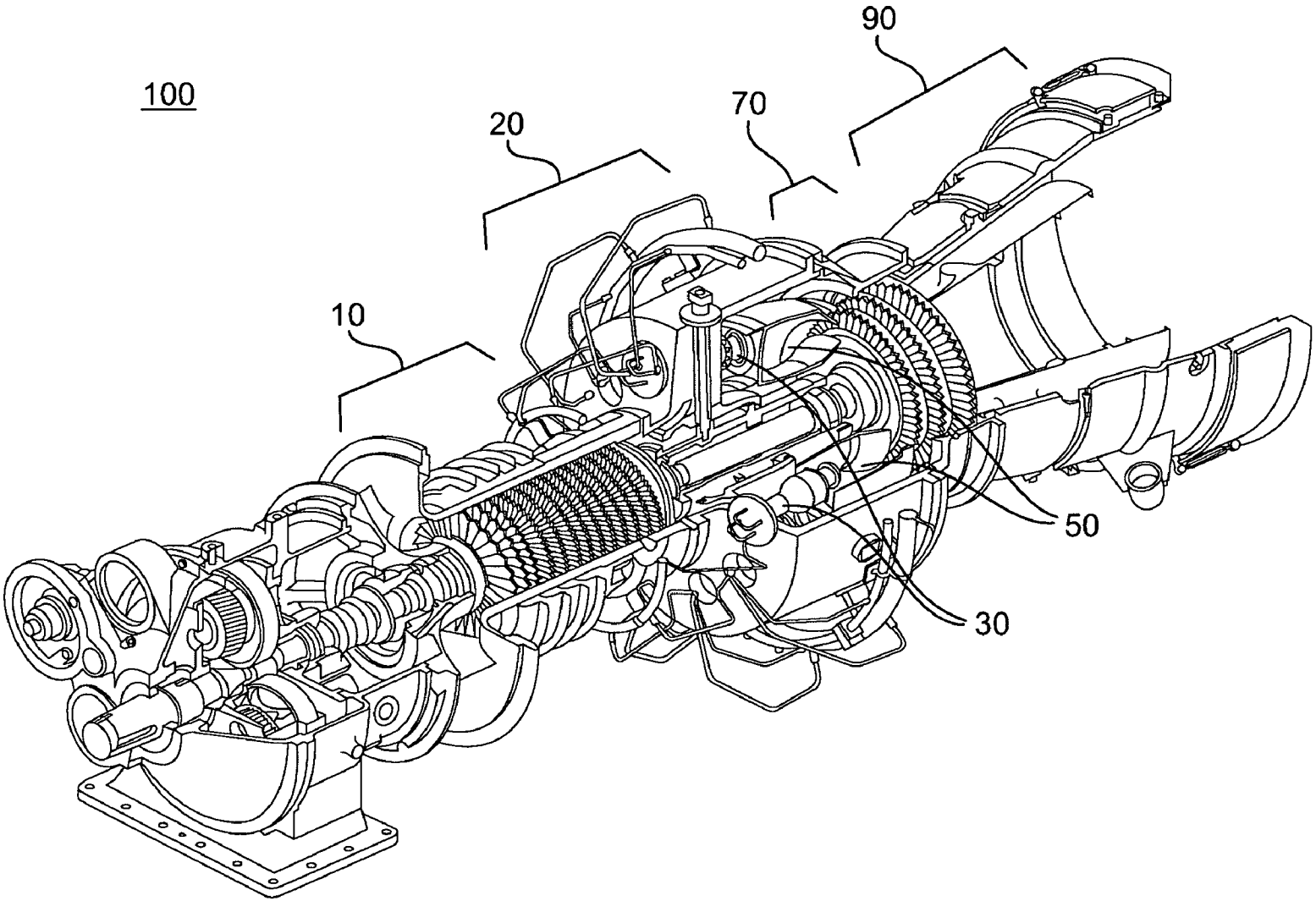
FIG. 1 is an illustration of an exemplary disclosed turbine engine system.

FIG. 1 illustrates an exemplary gas turbine engine 100. Turbine engine 100 may have, among other systems, a compressor system 10, a combustor system 20, a turbine system 70, and an exhaust system 90. In general, compressor system 10 compresses incoming air to a high pressure, combustor system 20 mixes the compressed air with a fuel and burns the mixture to produces high-pressure, high-velocity gas, and turbine system 70 extracts energy from the high-pressure, high-velocity gas flowing from the combustor system 20. It should be emphasized that, in this discussion, only those aspects of turbine engine 100 useful to illustrate the combustion control process will be discussed.

Compressor system 10 may include any device capable of compressing air. This compressed air may be directed to an inlet port of combustor system 20. Combustor system 20 may include a plurality of fuel injectors 30 configured to mix the compressed air with a fuel and deliver the mixture to one or more combustors 50 of combustor system 20. The fuel delivered to combustor 50 may include any liquid or gaseous fuel, such as diesel or natural gas. The fuel delivered to combustor 50 may undergo combustion to form a high pressure mixture of combustion byproducts. The high temperature and high pressure mixture from combustor 50 may be directed to turbine system 70. Energy may be extracted from these hot pressurized gases in turbine system 70. For instance, the hot combustion gases may rotate blades connected to a shaft of the turbine, and thereby produce power. The combustion gases may then exit turbine system 70 and optionally flow through exhaust after treatment systems (not shown) before being discharged to the atmosphere through exhaust system 90.

Figure 2:
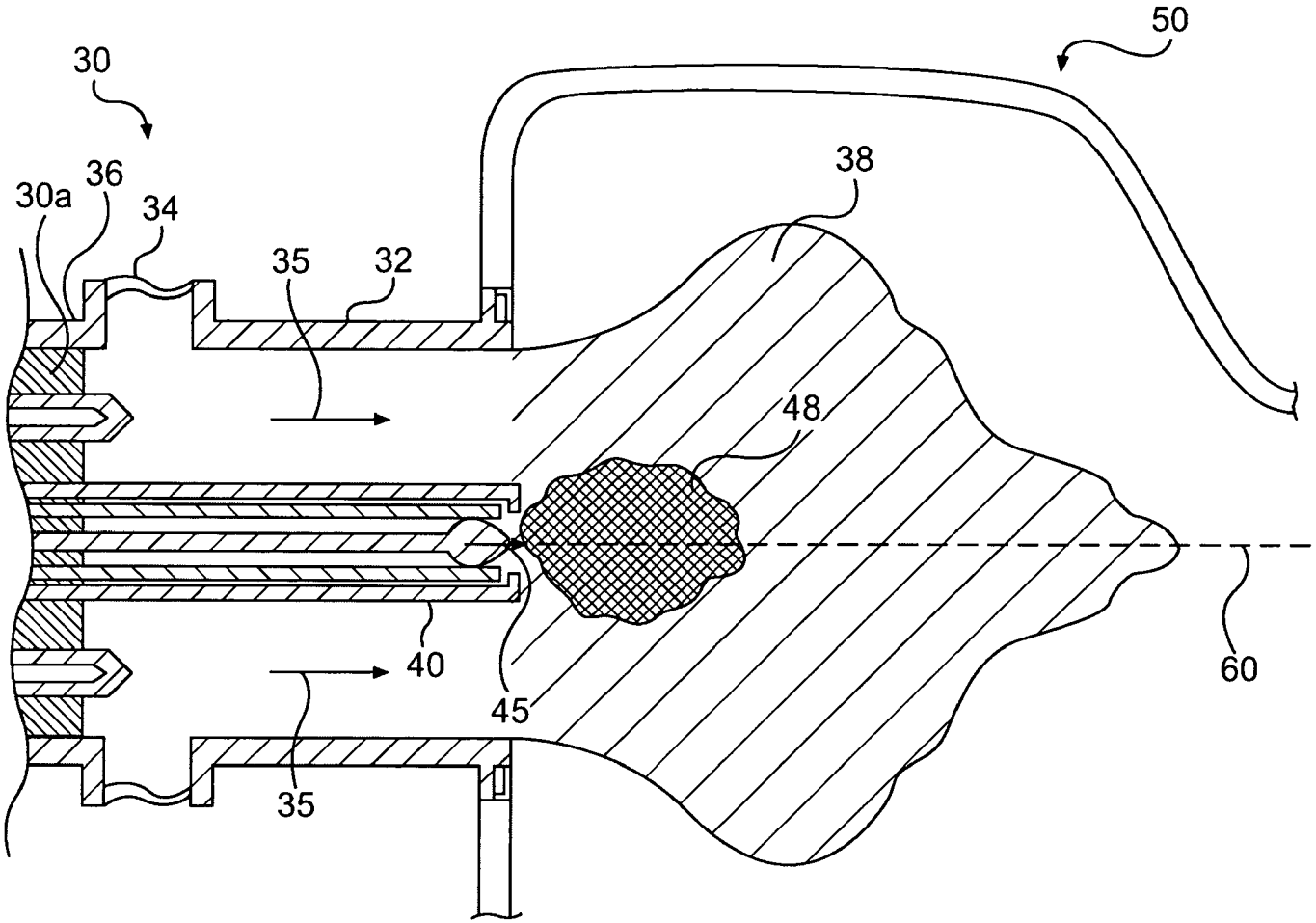
FIG. 2 is a schematic illustration of a fuel injector coupled to a combustor of the turbine engine of FIG. 1.

FIG. 2 illustrates a fuel injector 30 coupled to combustor 50. Fuel injector 30 may deliver fuel and air to combustor 50 for combustion. Combustion of fuel in combustor 50 may produce byproducts such as $NO_x$, carbon monoxide (CO), carbon dioxide ($CO_2$), and un-burnt hydrocarbons. Government regulations may limit, among others, the amount of $NO_x$ that may be discharged through exhaust system 90. Formation of $NO_x$ in combustor 50 may result from a reaction between oxygen and nitrogen at high temperatures. $NO_x$ formation may be reduced by reducing the temperature of the flame during combustion. Flame temperature may be reduced by reducing the concentration of fuel (in the fuel and air mixture) delivered to combustor 50. However, when the fuel concentration is too low, the combustion process may become unstable. Instability in the combustion process may lead to oscillations in the combustion rate that may generate pressure pulses in combustor 50. Instability in the combustion process may also lead to extinguishment of the flame (called "lean-blowout") in combustor 50. The combustion process in combustor 50 may be made stable by increasing the flame temperature in combustor 50. Therefore, for low $NO_x$ emission, a lean fuel-air mixture (that reduces flame temperature) may be desired, while for stable combustion a higher fuel concentration may be desired.

Some embodiments of fuel injectors include multiple flow paths that deliver different concentrations of fuel and air to combustor 50. These multiple flow paths may include a main flow path 35 and a pilot flow path 45. Main flow path 35 may deliver a premixed lean fuel-air mixture to combustor 50 (hereinafter referred to as "main fuel" stream). The concentration of fuel in the main fuel stream may be low enough to achieve target $NO_x$ emission without causing unstable combustion. The main fuel may burn in combustor 50 to create premixed flames 38. Premixed flames 38 are the flames that are created when fuel and air are first mixed in fuel injector 30 and then burned in combustor 50. The pilot flow path 45 may deliver a pressurized spray of fuel along with compressed air to combustor 50 (hereinafter referred to as "pilot fuel" stream). The pilot fuel stream may burn in combustor 50 to create a diffusion flame 48. Diffusion flames 48 are flames that are created when fuel and air mix and burn at the same time. Diffusion flames 48 may have a higher temperature than premixed flames 38 and may serve as a localized hot flame to stabilize the combustion process and prevent lean blowout.

In some embodiments, during normal operation, a majority of the fuel delivered to combustor 50 may be delivered through main flow path 35 and a small percentage may be delivered through pilot flow path 45. In some embodiments, during normal operation, about 90-99% of the total fuel supply to combustor may be delivered as the main fuel and 10-1% of the fuel may be delivered as the pilot fuel. A high proportion of the main fuel supply may enable the turbine engine to operate in a low $NO_x$ emitting mode during normal operation. At some operating conditions of turbine engine 100 (load, temperature, etc.), combustion process may become unstable and induce pressure pulses in combustor 50. Once these pressure pulses occur, they may continue until variables that affect the combustion process are changed, to shift the operation of the turbine engine 100 away from the unstable zone. In some embodiments of turbine engine 100, an unstable operating condition may be shifted by increasing the amount of pilot fuel delivered to combustor 50. As described earlier, the pilot fuel creates a diffusion flame 48 at a temperature that stabilizes the combustion process.

Fuel injector 30 may have a generally tubular configuration with an inner and an outer tube arranged concentrically about a longitudinal axis 60. The outer tube of fuel injector 30 may comprise a premix barrel 32 and the inner tube may comprise a pilot 40. Premix barrel may be coupled to combustor 50 one end and to an injector housing **30*a* at an opposite end. An annular space between premix barrel 32 and pilot 40 may include the main flow path 35 that delivers the main fuel stream to combustor 50. Housing 30*a* may include fuel lines and fuel galleries (not shown) that deliver fuel to fuel injector 30. Compressed air from compressor system 10 may be directed into fuel injector 30 through an air swirler 34. Air swirler 34 may include a plurality of curved or straight blades attached to fuel injector 30 to swirl the incoming compressed air. Fuel nozzles 36 coupled to housing 30*a* may inject fuel into the swirled air stream. Swirling the compressed air may help create a well mixed fuel-air mixture that comprises the main fuel supply. In embodiments of fuel injectors configured to deliver gaseous fuels or both liquid and gaseous fuels, fuel injector 30 may also include gas ports (not shown) to deliver the gaseous fuel to combustor 50**.

Pilot 40 may be disposed radially inwards of premix barrel 32. In some embodiments, pilot 40 and premix barrel 32 may be aligned both along longitudinal axis 60. Pilot 40 may include components configured to deliver fuel and compressed air in pilot 40. The fuel may include liquid and/or gaseous fuels. Pilot 40 may also include the pilot flow path 45. Pilot flow path 45 may include components (such as, ducts and nozzles) configured to inject fuel and compressed air into combustor 50. In embodiments of fuel injector 30 configured to deliver gaseous fuel or both liquid and gaseous fuel, pilot flow path 45 may include components configured to inject a stream of pressurized liquid and gaseous fuel into combustor 50. The pressurized stream of fuel and air delivered to combustor 50 through pilot flow path 45 may comprise the pilot fuel stream.

In the preceding discussion, fuel injector 30 has been described mainly with reference to main flow path 35 and pilot flow path 45 which deliver the main flow stream and the pilot fuel stream, respectively, to combustor 50. In the configuration of fuel injector 30 described herein, the main flow path 35 may be located circumferentially around pilot flow path 45. In this configuration, the main fuel may be directed to combustor 50 circumferentially around the pilot fuel, and the premixed flame 38 may be formed around diffusion flame 48. It should be emphasized that, although the disclosed combustion control process is illustrated using a specific configuration of fuel injector 30, the combustion control process of the current disclosure will be applicable to any turbine engine where a pilot fuel supply and a main fuel supply are directed to combustor 50.

As described earlier, when combustion in combustor 50 becomes unstable, pressure (or acoustic) pulses may be generated in combustor 50. These pressure pulses may range in frequency from a few hertz to a few thousand hertz. The lower frequency pressure pulses are sometimes referred to as "rumble," and higher frequency pressure pulses are sometimes referred to as "oscillation" or "screech." When a frequency of the pressure pulses match a natural frequency of the combustor 50, damaging structural vibrations may be induced in the combustor 50. These structural vibrations may damage the combustor 50 and/or other components of the turbine engine 100. A combustion control system may monitor the pressure pulses in combustor 50 and adjust the fuel flow into the combustor to prevent a pressure pulse at a frequency close to a natural frequency of the combustor 50.

Figure 3:
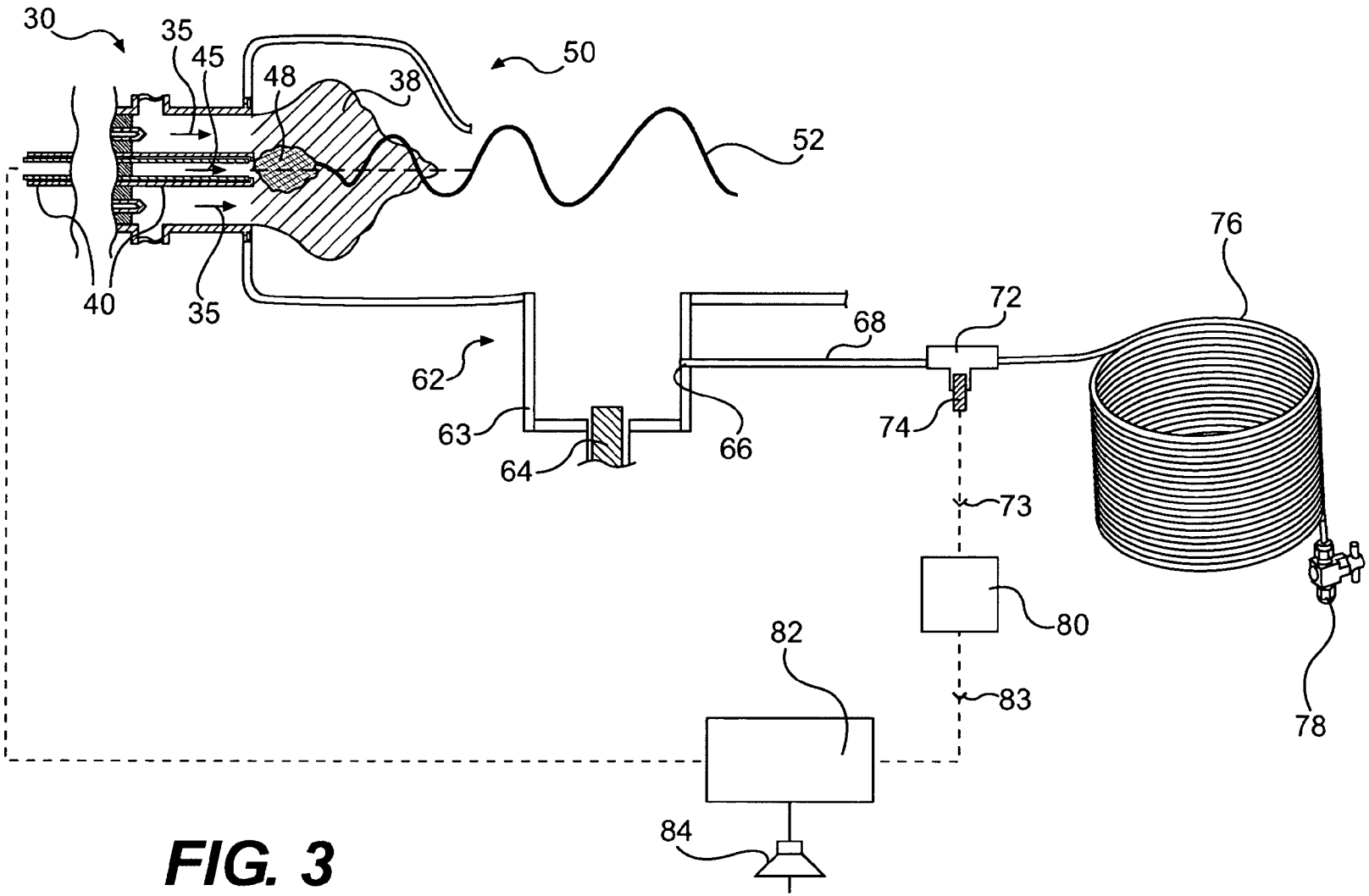
FIG. 3 is an illustration of an exemplary disclosed combustion control system of the turbine engine FIG. 1.

FIG. 3 illustrates a combustion control system that monitors pressure pulses within combustor 50 and takes corrective action when a pressure pulse is detected. The combustion control system may include a sensor 74 fluidly coupled to combustor 50 to detect a pressure pulse 52 within combustor 50. Sensor 74 may be positioned at a location where pressure pulse 52 may be detected accurately without being exposed to severe environmental conditions. Combustor 50 may include a torch igniter 62 fluidly coupled to combustor 50. Torch igniter 62 may be configured to ignite the fuel-air mixture in combustor 50. Torch igniter 62 may include an igniter 64 coupled to a torch access port 63. Torch access port 63 may include a side port 66 coupled thereto. A transfer tube 68 may be coupled at one end to side port 66. An opposite end of transfer tube 68 may be coupled to one end of a T-section 72. Sensor 74 may be coupled to a second end of T-section 72 to measure pressure pulse 52. A third end of T-section 72 may be coupled to a first end of a semi-infinite coil 76. Semi-infinite coil 76 may include a tube coiled to have a generally cylindrical shape. A drain valve 78 may be coupled to a second end of semi-infinite coil 76, opposite the first end. Drain valve 78 may be maintained in a closed position when turbine engine 100 is operating, and may be opened to discharge residue collected in the semi-infinite coil 76 during operation of turbine engine 100.

Semi-infinite coil 76 may serve to dissipate reflected pressure pulses in transfer tube 68. Dissipation in semi-infinite coil 76 may prevent the reflected pressure pulses from affecting the measurements of sensor 74. Semi-infinite coil 76 may thus serve to increase the accuracy and sensitivity of sensor 74 to pressure pulse 52. In some embodiments, semi-infinite coil may be made of a metallic material, such as stainless steel or copper. In general, the size and shape of semi-infinite coil may depend upon the combustion and acoustic characteristics of turbine engine 100. In some embodiments, semi-infinite coil 76 may include a tube having a total length between about 20 feet to 60 feet and an outer diameter between about 0.125 inches to 0.375 inches, coiled to have a substantially cylindrical shape having a diameter between about 7 to 12 inches. However, it should be emphasized that the disclosed combustion control process is not limited by the size and shape of the semi-infinite coil 76. For instance, in some embodiments, semi-infinite coil 76 may have the general shape of a straight tube. In general, any structure that is capable of accentuating amplitude of pressure pulse 52 may serve as semi-infinite coil 76.

Sensor 74 may be a piezoelectric sensor configured to measure pressure pulses 52 within combustor 50. It is contemplated that sensor 74 may include any kind of sensor known in the art that is capable of measuring pressure pulses 52. Sensor 74 may output a signal 73 that corresponds to pressure pulse 52. Signal 73 may be input into a signal conditioner 80. Signal conditioner 80 may perform one or more signal conditioning operations, such as transformation of signal 73 from the time domain to the frequency domain. Signal conditioner 80 may also include band pass filters configured to allow signals within a predefined frequency range to pass through. These predefined frequency ranges could include one or more frequency ranges that span a natural frequency of combustor 50. An output signal 83 from signal conditioner 80 may include an electrical signal that corresponds to an amplitude of pressure pulse 52 within the predefined frequency range.

Output signal 83 may be input into a controller 82. Controller 82 may be configured to compare output signal 83 to one or more threshold values, and perform one or more actions in response to the comparison. These threshold values may be stored in a memory of the controller 82, or may be selected by hardware settings (for instance, settings of switches or dials). For instance, if the amplitude of output signal 83 is above a threshold amplitude, controller 82 may sound an alarm 84. Controller 82 may also actively control turbine engine 100 in response to a comparison. The active control may include varying the fuel supply to combustor 50. For instance, if a comparison indicates that the amplitude of output signal is above a threshold amplitude, controller 82 may increase the amount of fuel delivered to combustor 50 through pilot 40. As described earlier, increasing pilot fuel supply may tend to eliminate (or decrease amplitude of) pressure pulse 52 by increasing the temperature of the combustion flame. In some embodiments, controller 82 may also decrease the amount of fuel delivered to combustor through the main flow path 35 (that, is the main fuel supply). In some embodiments, the increase in pilot fuel and the decrease in main fuel may be such that the total fuel supplied to combustor may be a constant.

INDUSTRIAL APPLICABILITY

The disclosed embodiments relate to a system and a process for active combustion control of a turbine engine. A fuel injector delivers multiple streams of fuel and compressed air to a combustor of the turbine engine. These multiple streams include a lean premixed fuel air mixture delivered through a main flow path and a pressurized stream of fuel and air delivered through a pilot flow path. The lean premixed fuel air mixture burns in combustor at a low temperature, and thereby, produces low $NO_x$ emissions, and the stream of fuel and air burn at a relatively higher temperature to produce higher $NO_x$ emissions. During normal operation, a majority of the fuel to combustor may be delivered through the main flow path and the turbine may operate in a low $NO_x$ emitting mode. At some operating conditions, combustion in the turbine engine may be unstable. Unstable combustion may generate pressure pulses in the combustor. A sensor fluidly coupled to the combustor may output a signal indicative of the pressure pulse in the combustor. A controller electrically coupled to the sensor may actively control the amount of fuel delivered to combustor through the main and pilot flow paths to prevent pressure pulses in combustor and minimize $NO_x$ emissions. To illustrate an application of the disclosed combustion control process, an exemplary embodiment will now be described.

Figure 4:
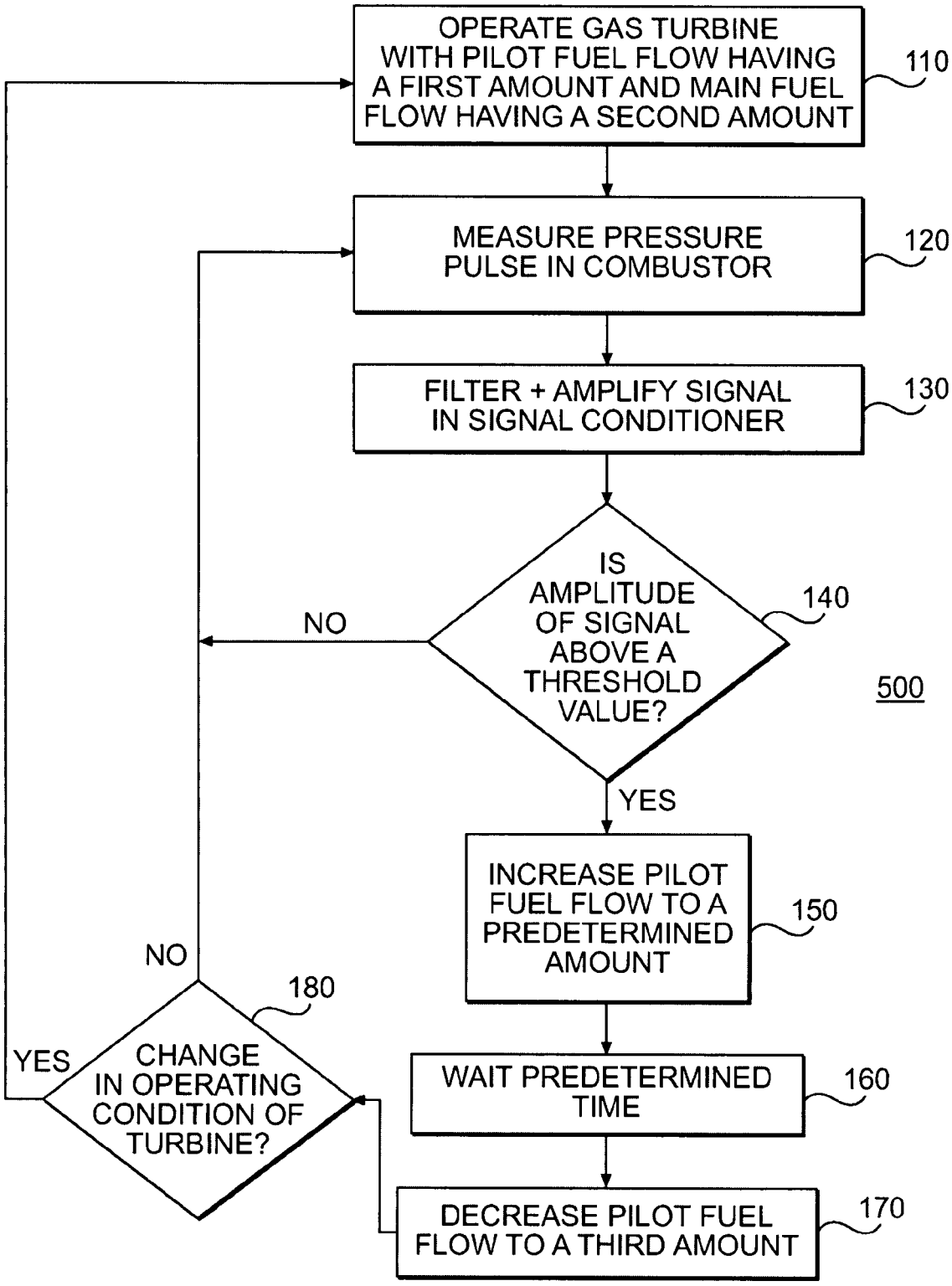
FIG. 4 is a flow chart illustrating an exemplary disclosed embodiment of the combustion control process of the turbine engine of FIG. 1.

FIG. 4 illustrates a flow chart depicting an embodiment of the process 500 for active combustion control of turbine engine 100. Turbine engine 100 may include a fuel injector 30 having a main flow path 35 and a pilot flow path 45 coupled to a combustor 50 of the turbine engine (as shown in FIG. 2). The main flow path 45 may deliver a lean premixed fuel-air mixture to combustor 50 and the pilot flow path 45 may deliver a stream of pressurized fuel and air to combustor 50. In general, main flow path 35 may deliver a first amount of fuel to combustor 50 and the pilot flow path 45 may deliver a second amount of fuel to combustor 50 (step 110). During normal operation of turbine engine 100, the first amount may account for about 98% of the total fuel supply to combustor 50, and the second amount may account for the remaining 2%. In this fuel flow condition, turbine engine 100 may operate in a stable combustion zone, and the $NO_x$ emission of turbine engine 100 may be within acceptable limits. A change in load coupled to turbine engine 100 may shift the operation of turbine engine 100 into an unstable zone. Unstable combustion may generate a pressure pulse 52 in combustor 50 (see FIG. 3).

During the operation of turbine engine 100, sensor 74 coupled to transfer tube 68, may continuously measure pressure fluctuations generated within combustor 50 to detect a changes in pressure signal as the turbine engine 100 enters an unstable zone (step 120). Sensor 74, thus, may measure a signal indicative of pressure pulse 52. Sensor 74 may be electrically connected to devices that are configured to identify a pressure pulse that exceeds a threshold value. In some embodiments, the threshold value may represent amplitude of a pressure pulse having a frequency close to a natural frequency of combustor 50. In an exemplary embodiment, combustor 50 may have natural frequencies of 350 Hz and 550 Hz. The measured signal from sensor 74 may be connected to a signal conditioner 80 that may include a signal amplifier to amplify the signal and/or a band pass filter that allows only signals within a pre-assigned frequency range to pass through. In the exemplary embodiment, where two natural frequencies of turbine engine 100 are 350 Hz and 550 Hz, these pre-assigned frequency ranges may be about 300-400 Hz and about 500-600 Hz. Signal conditioner 80 may, thus, filter noise and amplify a signal measured by sensor 74 (step 130).

The filtered signal may be input into a controller 82 that may be configured to control the fuel supply to combustor 50. One or more threshold values of amplitude may be stored in controller 82. As described earlier, these threshold values may include a threshold amplitude of a pressure pulse 52 having a frequency within the pre-assigned frequency range (of signal conditioner 80). For instance, in previously described exemplary embodiment, signal conditioner 80 may direct output signal 83 having frequency between about 300-400 Hz or about 500-600 Hz to controller 82. Controller 82 may compare the amplitude of output signal 83 with one or more threshold amplitude values stored therein (step 140), and initiate an action in response to a result of the comparison.

If the output signal 83 is not above the one or more threshold values, the controller 82 may not initiate any corrective action, and will continue monitoring signals measured by sensor 74. If the output signal 83 is above a threshold value, controller 82 may increase pilot fuel supply to a pre-determined value (step 150). In some embodiments, this predetermined value may be a value of pilot fuel supply that may be sufficient to stabilize the combustion process. Stabilization of the combustion process may decrease or eliminate pressure pulse 52. In some embodiments, increasing pilot fuel supply may change the amplitude of the pressure pulse to below the threshold value. The pre-determined value of pilot fuel flow may be determined by computations or prior experience. In some embodiments, the pre-determined value of pilot fuel supply may be higher than about 10% of the total fuel supply. Although this pre-determined value may be depend upon the characteristics and operating conditions of turbine engine 100, in some applications, this pre-determined value may be between about 30% to 40% of the total fuel supply.

In some embodiments of the active combustion control process, in addition to increasing pilot fuel supply, step 150 may also include decreasing the main fuel supply to keep the total fuel supply to combustor 50 a constant. For instance, in an embodiment where the pilot fuel supply is increased to about 30% of the total fuel supply to stabilize the combustion process, the main fuel supply may be decreased to about 70% of the total fuel supply to keep the total fuel supply to combustor 50 approximately the same as during normal operation. In some embodiments, controller 82 may initiate additional actions if an amplitude of the measured pressure pulse is above a threshold value. The additional actions may include sounding an alarm, flashing a light, or other actions designed to make an operator aware of the unstable combustion in combustor 50.

After increasing the pilot fuel supply to a pre-determined value, the controller 82 may wait for a pre-determined time (step 160). Waiting for a pre-determined time may allow the combustion process to stabilize and for pressure pulse 52 in combustor 50 to decrease. This pre-determined time may be a value preset in controller 82 by software or hardware methods. Software methods may include entering a value of time in a memory and hardware methods may include setting the time on a dial. In some embodiments, this pre-determined time may be between about 10 seconds to a few minutes.

After waiting for the pre-determined amount of time, the controller 82 may decrease the pilot fuel supply back to a third amount. The third amount may be equal to the first amount plus an additive amount (step 170). In some embodiments, step 170 may also include increasing the main fuel supply to a fourth amount to keep the total fuel supply to combustor 50 a constant. This fourth amount may equal the second amount minus the additive amount. The additive amount may generally be any small incremental value that slightly increases the pilot fuel supply and tend to stabilize the combustion process. Although, the additive amount may depend upon the application, in general, the additive amount may vary from about 0.05% to 1%. In an embodiment, where the first value is about 2% of the total fuel supply and the pilot fuel supply was increased to 30% of the total fuel supply to stabilize the combustion process, step 170 may include decreasing the pilot fuel supply to about 2.125%.

The effect of decreasing the pilot fuel supply to the third amount may depend upon the application. In cases where a small perturbation of the operating condition of the turbine engine 100 had made combustion slightly unstable, decreasing the pilot fuel supply back to the third amount may not disturb the stable combustion condition achieved by increasing the pilot fuel supply in step 150. However, in situations where combustion process was significantly unstable, decreasing the pilot fuel supply to third amount may again make combustion unstable. The controller 82 may, therefore, continue to monitor measured signals from sensor 74 to identify unstable combustion (step 120).

If the measured signals indicate that combustion is again unstable, the controller may increase the pilot fuel flow again to value sufficient to stabilize combustion (step 150), wait the pre-determined amount of time (step 160), and decrease the pilot fuel supply to a value slightly higher than the third amount (that is, third amount plus the additive amount). For example, in the embodiment where the pilot fuel supply was increased to about 30% of the total fuel flow to quench pressure pulse 52, and then decreased to a third value of about 2.125%, upon sensing further instability, the controller 82 may increase the pilot fuel supply back to about 30% of the total fuel flow and decrease it to about 2.25% (2.125%+ 0.125%). Controller 82 may also decrease pilot fuel supply when the combustion is stable. Decreasing pilot fuel supply be carried out in the same manner pilot fuel supply is increased. For example, when stable operation is sensed at an operating point, controller 82 may decrease pilot fuel flow by an incremental amount, and wait for a pre-determined time. When combustion is sensed as stable (that is, no pressure pulses within a pre-determined frequency range having an amplitude above the threshold amplitude are detected) at the new incrementally lower pilot fuel flow, another decrease in pilot fuel flow may be made. This process may continue until the original pilot flow level is reached, or an instability is detected. The controller may, thus, adjust the pilot fuel flow to a value that is just sufficient to stabilize combustion without an excessive increase in $NO_x$ emission.

The process of measuring the pressure pulses within combustor 50 and modifying the pilot fuel flow may continue until a change in operating condition of the turbine engine 100 is detected. A change in operating condition may include conditions such as, a change in the load, ambient temperature, etc. Upon sensing a change in operating condition (step 180), the pilot fuel supply and the main fuel supply may be reset. In some embodiments, the pilot fuel supply may be reset to the first amount and the main fuel supply may be reset to the second amount. Sensor 74 may continue to monitor the pressure pulses within combustor 50. Upon sensing a pressure pulse generated by combustion instability, the controller 82 quickly stabilizes the combustion process by increasing the pilot fuel supply to a value which will stabilize the combustion process, and adjust pilot fuel flow to a value that is just enough to prevent combustion instability. By quickly stabilizing the combustion process, the pressure pulses in the combustor 50 are quickly eliminated. Quick elimination of damaging pressure pulses decreases the possibility of damage to turbine engine 100 as a result of these pressure pulses.

It will be apparent to those skilled in the art that various modifications and variations can be made to the disclosed system and process for combustion control of a turbine engine. Other embodiments will be apparent to those skilled in the art from consideration of the specification and practice of the disclosed system and process for combustion control of the turbine engine. It is intended that the specification and examples be considered as exemplary only, with a true scope being indicated by the following claims and their equivalents.

What is claimed is:

1. A method of operating a gas turbine engine comprising:

directing a first amount of fuel into a combustor through a main flow path;

directing a second amount of fuel into the combustor through a pilot flow path;

combusting the main fuel and the pilot fuel in the combustor;

detecting an amplitude of a pressure pulse within a frequency range using a sensor fluidly coupled to the combustor;

increasing the pilot fuel to a third amount in response to the detected amplitude being above a threshold value;

waiting a predetermined amount of time after the increasing; and decreasing the pilot fuel from the third amount to a fourth amount after the waiting, the fourth amount being an amount of pilot fuel that is greater than the second amount;

wherein the detecting includes sensing the pressure pulse using the sensor which is coupled to a tube that fluidly couples the combustor to a coil that is adapted to dissipated the pressure pulse in the tube.

2. The method of claim 1, wherein directing a first amount of fuel includes directing the first amount of fuel through a main flow path located circumferentially around the pilot flow path.

3. The method of claim 1, wherein the third amount is an amount of pilot fuel that is sufficient to decrease the amplitude below the threshold value.

4. The method of claim 1, further including increasing the pilot flow from the fourth amount to the third amount in response to an amplitude that is above the threshold amplitude.

5. The method of claim 4, further including decreasing the pilot flow from the third amount to a fifth amount, the fifth amount being an amount of pilot fuel that is greater than the fourth amount by the incremental amount.

6. The method of claim 1, further including waiting a pre-determined amount of time between increasing the pilot fuel to the third amount and decreasing the pilot fuel from the third amount to the fourth amount.

7. The method of claim 1, wherein increasing the pilot fuel to a third amount includes decreasing the main fuel to a lower amount such that a total amount of main fuel and pilot fuel delivered to the combustor remains substantially a constant.

8. The method of claim 1, wherein decreasing the pilot fuel from the third amount to the fourth amount includes increasing the main fuel to a higher amount such that a total amount of main fuel and pilot fuel delivered to the combustor remains substantially a constant.

9. The method of claim 1, wherein the second amount is between about 1% to about 10% of a total amount of main fuel and pilot fuel delivered to combustor, and the fourth amount is greater than the second amount by between about 0.05% to 1% of the total amount.

10. A method of combustion control of a gas turbine engine comprising:

directing a first amount of first fuel into a combustor of the turbine engine;

directing a second amount of second fuel into the combustor circumferentially around the first fuel, a sum of the first amount and the second amount being a total fuel supply to the combustor;

detecting a combustion induced pressure pulse in the combustor;

detecting an amplitude of the pressure pulse that is within a frequency range;

increasing the first fuel amount to a third amount in response to an amplitude that is above a threshold value, the third amount being greater than about 10% of the total fuel supply; and decreasing the first amount from the third amount to a fourth amount, the fourth amount being about 0.05% to about 1% greater than the first amount;

wherein the detecting includes sensing the pressure pulse using the sensor which is coupled to a tube that fluidly couples the combustor to a coil that is adapted to dissipated the pressure pulse in the tube.

11. The method of claim 10, wherein the first amount is less than about 10% of the total fuel supply.

12. The method of claim 11, further including, increasing the first fuel amount from the fourth amount to the third amount in response to an amplitude that is above a threshold value; and decreasing the first fuel amount from the third amount to a fifth amount, the fifth amount being about 0.05% to about 1% greater than the fourth amount.

13. The method of claim 10, further including sounding an alarm in response to an amplitude that is above a threshold value.

* * * * *